United States Patent [19]

Taylor-Smith

[11] 4,221,505

[45] Sep. 9, 1980

[54] SUB-SURFACE IRRIGATION CHANNEL

[76] Inventor: Ernest J. Taylor-Smith, 2905 W. 37th Ave., Vancouver, Bristish Columbia, Canada, V6N 2T8

[21] Appl. No.: 887,535

[22] Filed: Mar. 17, 1978

[51] Int. Cl.[2] ..... E02D 3/04; E02B 11/00

[52] U.S. Cl. ..... 405/303; 37/98; 37/142.5; 172/4.5; 405/36

[58] Field of Search ..... 405/118, 116, 36, 46, 405/174, 175, 179, 180, 181, 161, 155; 299/1; 404/77, 95, 91, 84, 111; 37/142.5, 97, 98, DIG. 20; 172/4.5

[56] References Cited

U.S. PATENT DOCUMENTS

| | | | |
|---|---|---|---|
| 2,201,493 | 5/1940 | Jorgensen | 404/91 X |
| 2,211,262 | 8/1940 | Flynn | 404/91 |
| 2,738,745 | 3/1956 | Harpold | 405/179 X |
| 2,788,725 | 4/1957 | Wilkey et al. | 37/98 |
| 3,203,188 | 8/1965 | Evans | 405/179 |
| 3,332,249 | 7/1967 | Idoine | 405/179 |
| 3,516,182 | 6/1970 | Wykert | 37/DIG. 20 |
| 3,585,804 | 6/1971 | Sramek | 405/36 X |
| 3,727,332 | 4/1973 | Zimmer | 299/1 X |

FOREIGN PATENT DOCUMENTS

| | | | |
|---|---|---|---|
| 1176064 | 8/1964 | Fed. Rep. of Germany | 405/36 |

*Primary Examiner*—Dennis L. Taylor

*Attorney, Agent, or Firm*—Fulwider, Patton, Rieber, Lee & Utecht

[57] ABSTRACT

Apparatus including a digger for digging a trench to a predetermined level which is maintained by control apparatus responsive to a laser beam plane. The earth removed by the digger is directed into screening apparatus, and at least some of the fine particles therefrom are spread over the bottom of the trench to a predetermined depth. A roller unit follows the digger and presses a system of channels in the trench bottom. The coarser particles from the screening apparatus are then spread over the trench bottom and the channels. If desired, the apparatus may include means for directing a sealant over the surfaces of the channels before the coarse particles are directed thereover.

38 Claims, 12 Drawing Figures

Figure 1:
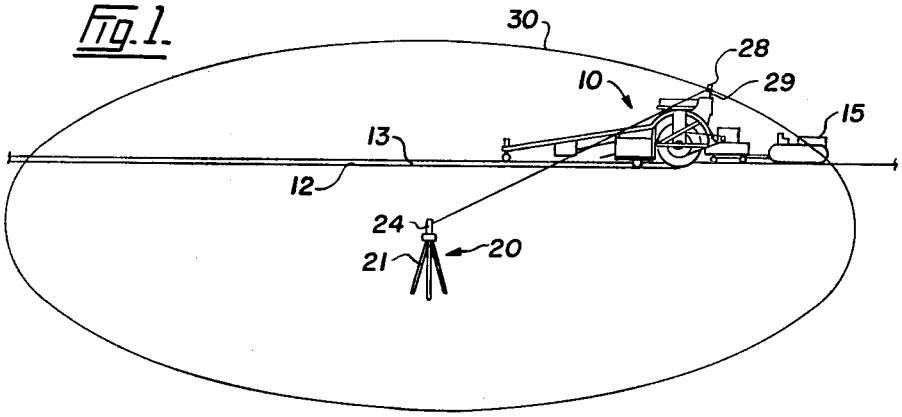

Fig. 5.
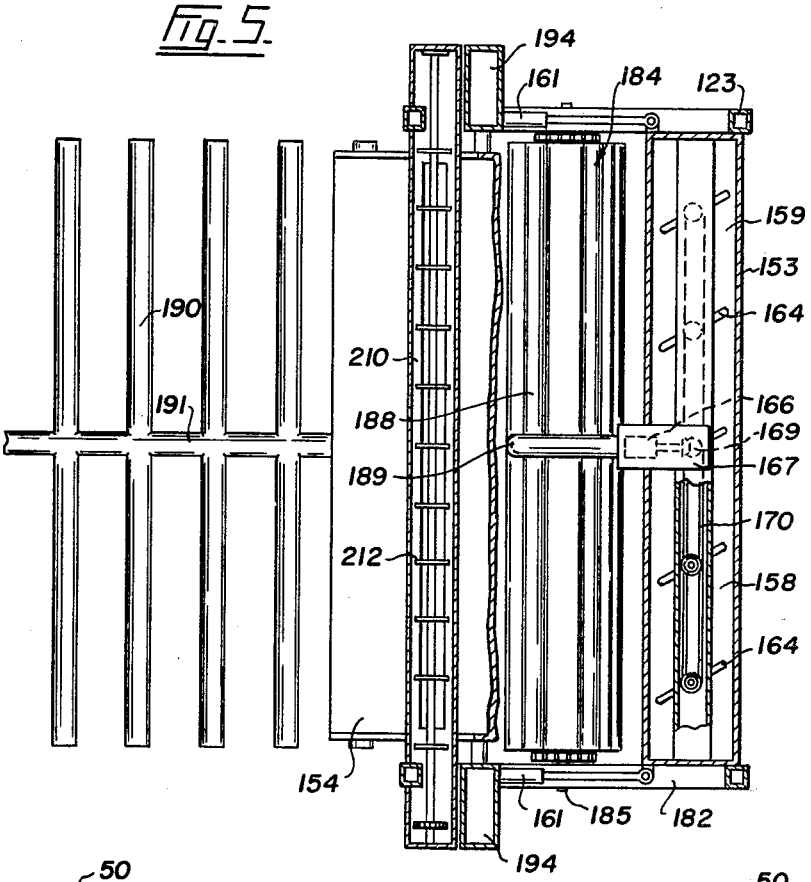
Fig. 6.
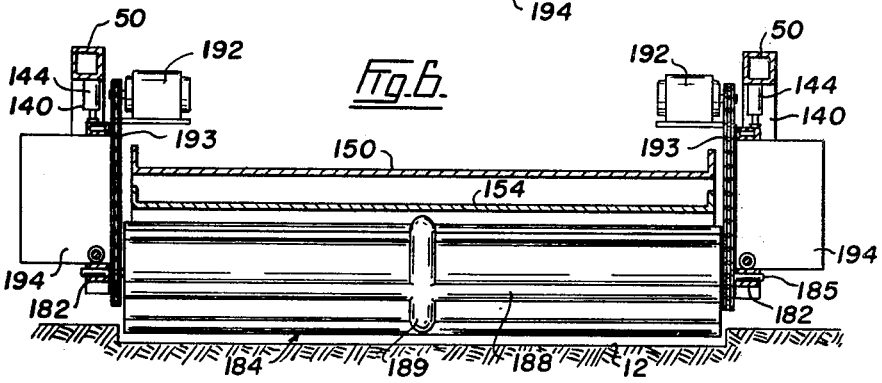
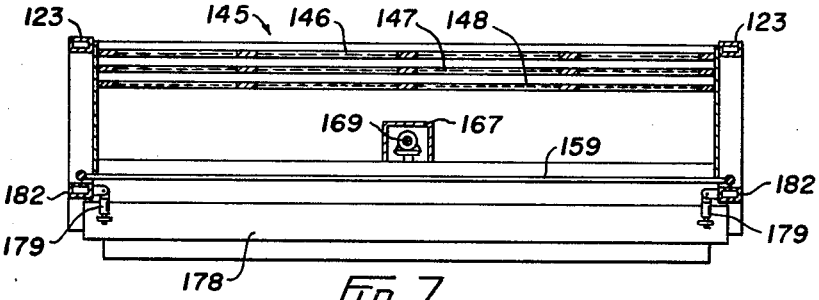
Fig. 7.

SUB-SURFACE IRRIGATION CHANNEL

The present invention relates to apparatus in vehicular form for digging earth out of the ground to form a trench, forming a channel system in the bottom of the trench, and returning the removed earth to the trench.

The advantages of sub-surface irrigation have been known for a long time, but it has not been practicle to irrigate large areas in this manner mainly because of the cost of setting up an underground irrigation system. The following U.S. patents disclosed efforts in this direction:

U.S. Pat. No. 668,362, dated Feb. 19, 1901, shows apparatus for continuously forming a concrete trough below ground level.

U.S. Pat. No. 2,159,690, dated May 23, 1939, discloses the idea of forming a concrete-like conduit in the ground.

U.S. Pat. No. 3,618,329, dated Nov. 9, 1971, covers apparatus for installing a moisture barrier of water-impervious plastic material below ground level.

U.S. Pat. No. 3,813,888, dated June 4, 1974, reveals apparatus for digging a trench and continuously laying a pipe along the bottom thereof, following which the earth is filled in over the pipe.

The apparatus of the present invention digs a trench to a predetermined level relative to a plane such as a laser beam plane above the ground. A system of water channels is pressed into the bottom of the trench, and the materials that have been dug out to form the trench are returned thereto. The channel system may be formed directly in the bottom of the trench, but it is preferable to screen the material dug from the trench, and to lay fine material therefrom on the bottom of the trench to a predetermined depth, after which the channel system is pressed into this layer. The coarse materials are directed over the channels and the trench bottom. The returned material is coarse enough so that when water is directed into the channel system it will flow throughout this system and thereby be available through capillary action for plants growing at the surface of the ground. If desired, a sealant may be directed over the surfaces of the channels before the coarse material is directed into them. In addition to this, if the soil is not coarse enough to allow for a reasonable flow of water through the channel system, coarse particles supplied for this purpose may be directed into the channels either alone or mixed with the coarse particles of earth so as to ensure a proper water flow. The basic idea is that the earth is dug out of the trench and following the formation of the channel system in the trench bottom, this earth is directed back into the trench.

As the terrain may be relatively rough over which the apparatus or vehicle is moved, the latter includes means for maintaining the trench bottom at a constant level regardless of the variations in the ground surface. The apparatus includes a digger mounted for vertical movement, and a control system which shifts the digger downwardly when the apparatus rises, and vice versa. The apparatus also includes means for compensating for any lateral incline of the ground so that the channel system is maintained substantially level or at a predetermined incline to create a desired flow of water through the channel system.

A vehicle in accordance with this invention comprises a main frame to be moved over the ground, a digger unit mounted on the frame and operable to removed earth from the ground to form a trench of a predetermined width with a bottom below ground level, a channel-forming unit on the frame behind the digger unit with reference to the direction of movement of the main frame operable to form a system of channels in the bottom of the trench, and distributing means on the frame behind the channel-forming unit for spreading earth removed by the digger unit back over the trench bottom.

More specifically, the present apparatus comprises a main frame to be moved over the ground, a wheel unit at a front end of the frame, a digger drum unit mounted on the frame to rotate around a substantially horizontal transverse axis to remove earth from the ground to form a trench of a predetermined width with a bottom below ground level, said digger unit also being mounted for selected vertical movement relative to the frame, power means connected to the digger unit to raise and lower said digger unit to maintain the bottom of the trench at a constant level, means for receiving earth dug out by the digger unit, a channel-forming unit on the frame behind the digger unit with reference to the direction of movement of the main frame operable to form a system of channels in the bottom of the trench, and distributing means on the frame behind the channel-forming unit for spreading earth from said receiving means back over the trench bottom.

Figure 3:
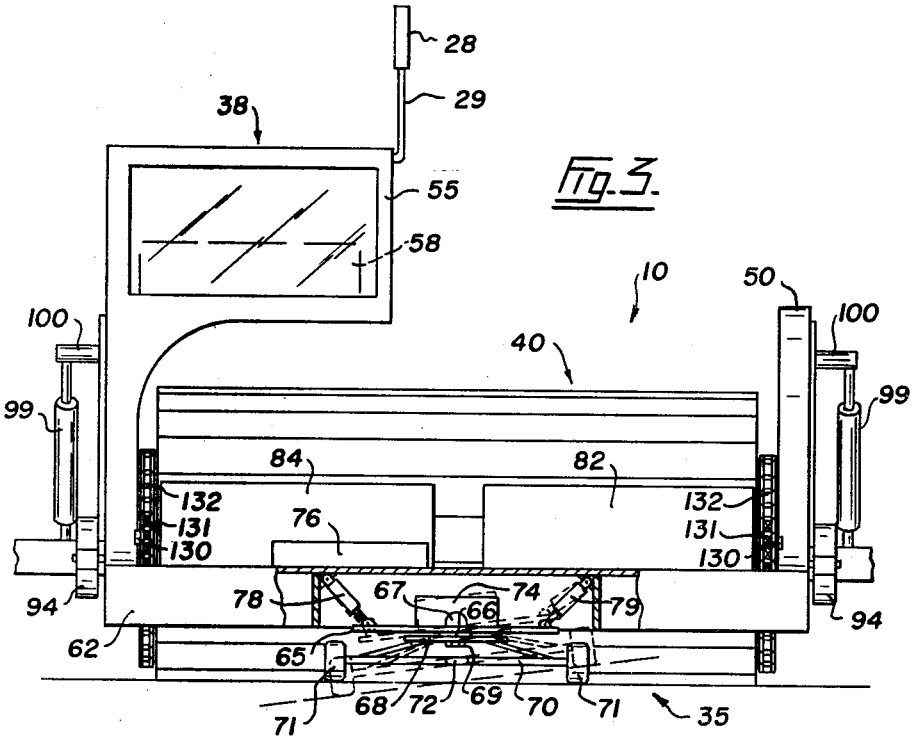
Figure 2:
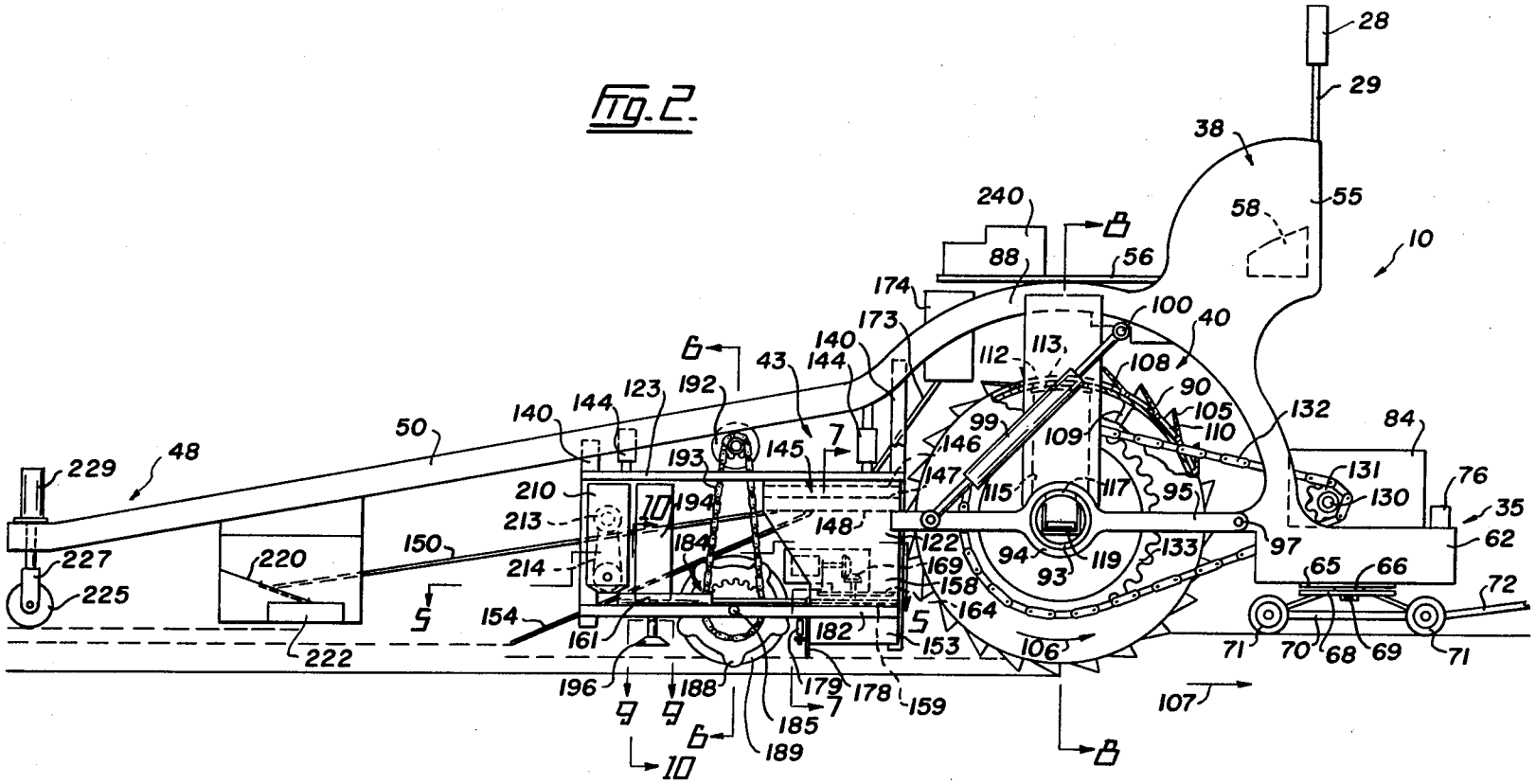
Figure 4:
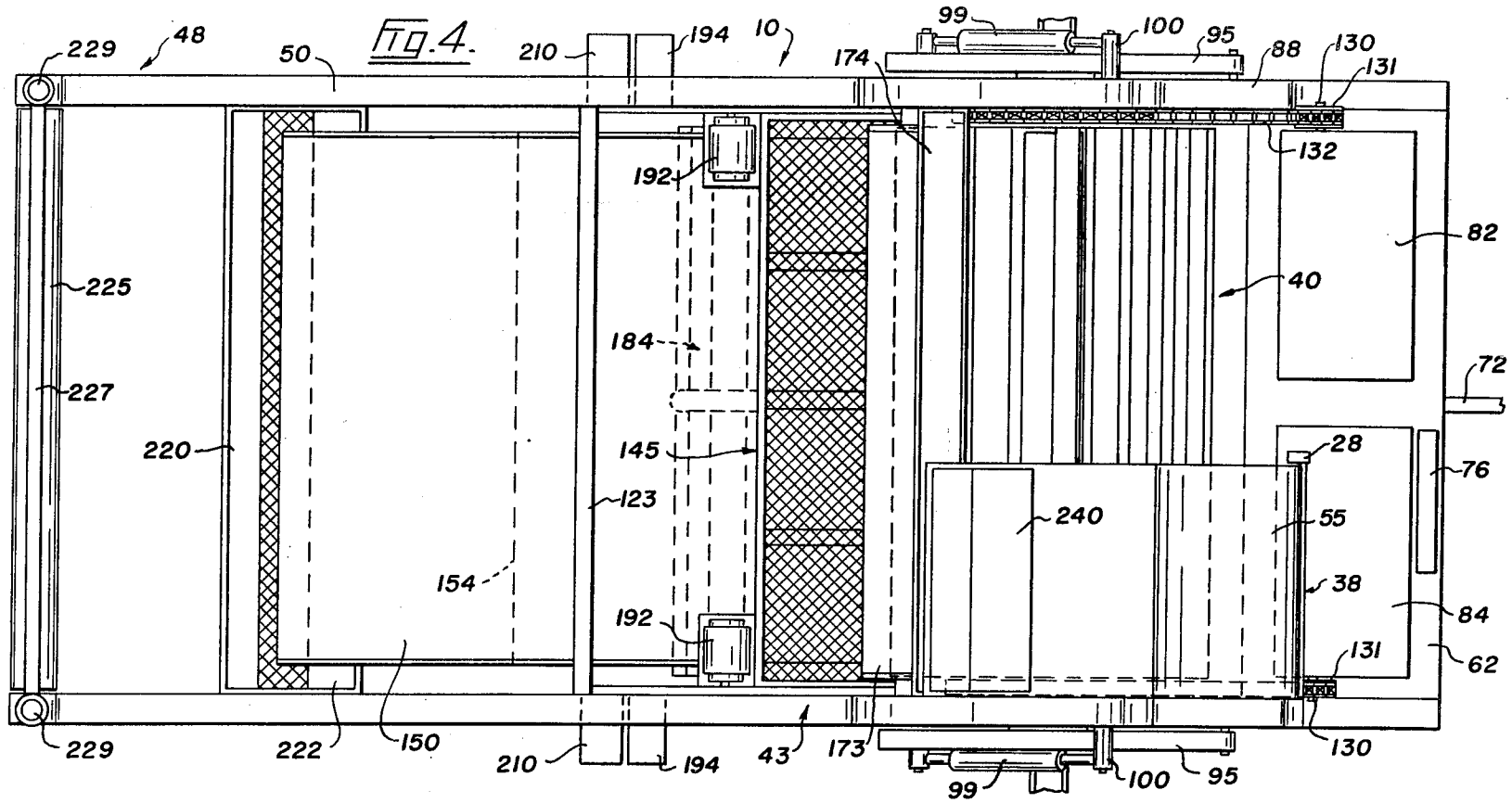
Figure 8:
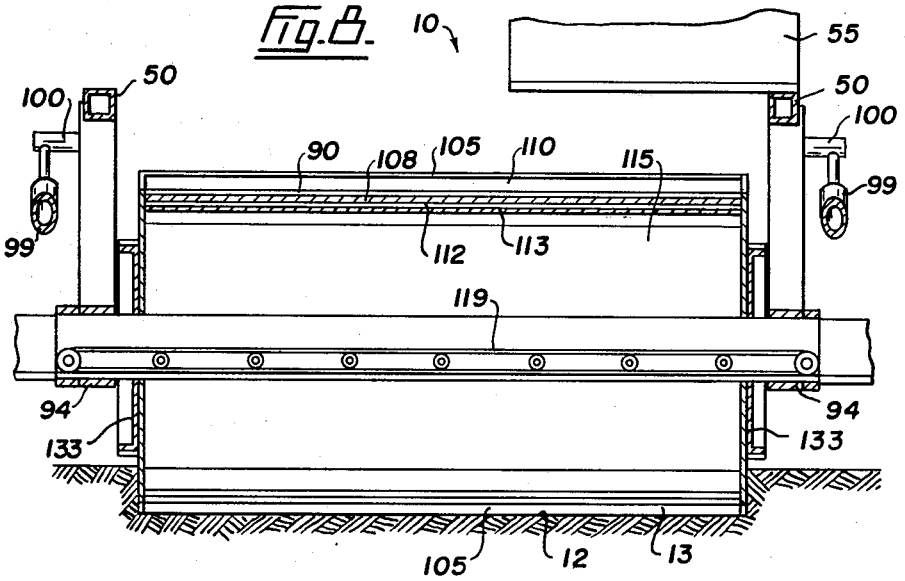
Figure 9:
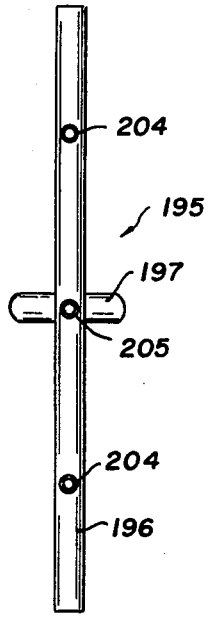
Figure 10:
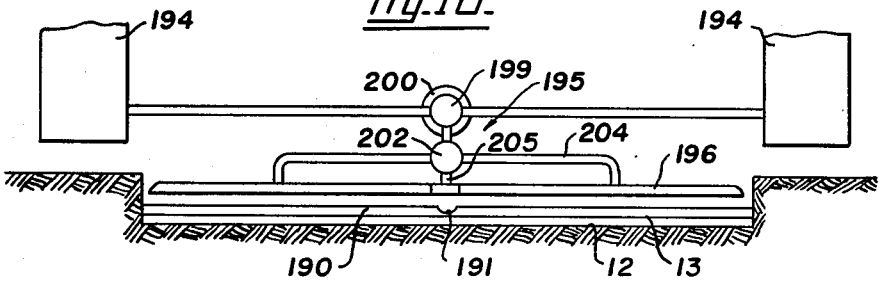
Figure 11:
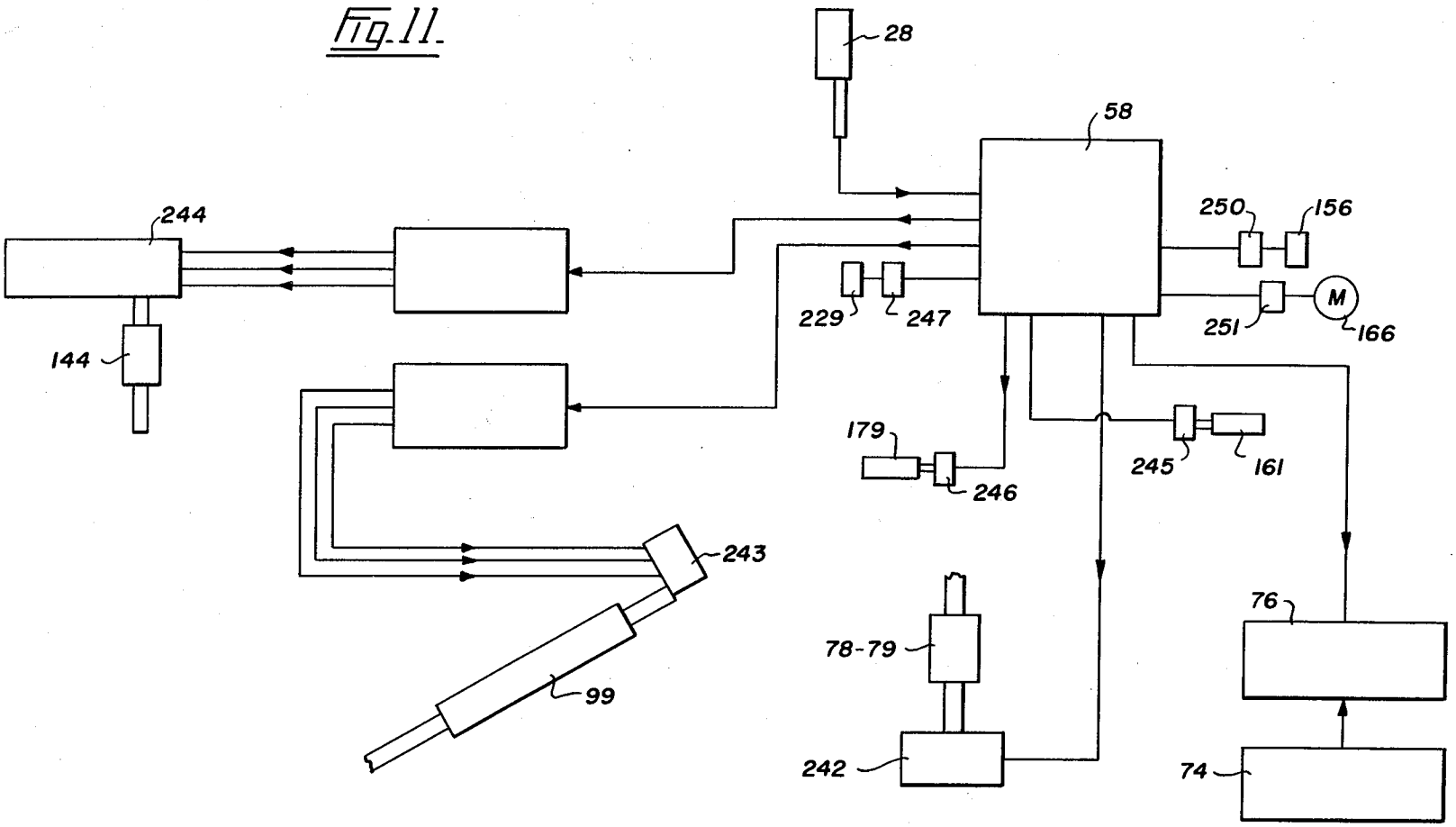
Figure 12:
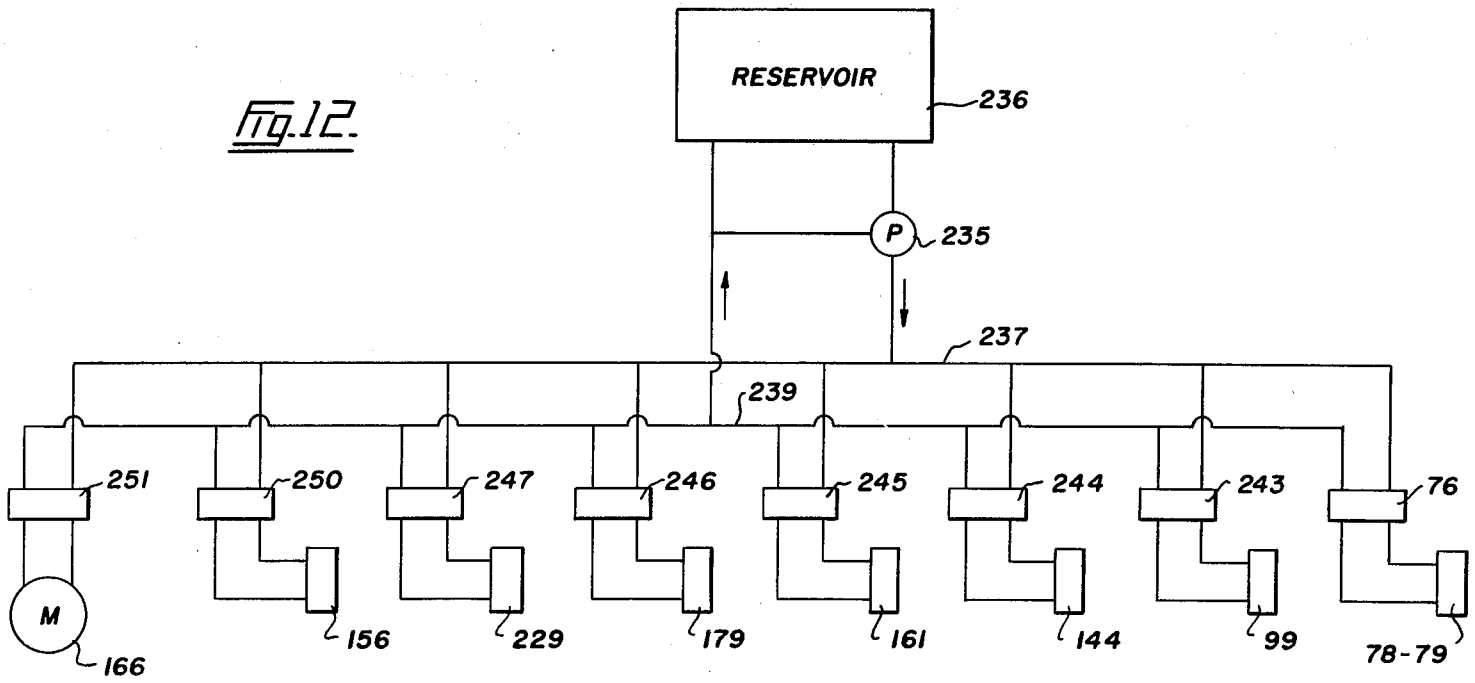

A preferred form of apparatus according to this invention is more or less diagrammatically illustrated by way of example in the accompanying drawings, in which:

FIG. 1 diagrammatically illustrates the irrigating channel-forming vehicle in operation, FIG. 2 is a side elevation with parts broken-away of the channel forming apparatus, FIG. 3 is a front end elevation of the vehicle, partly in section, FIG. 4 is a plan view of the apparatus of FIG. 2, FIG. 5 is a longitudinal horizontal section taken on the line 5—5 of FIG. 2, FIG. 6 is a vertical section taken on the line 6—6 of FIG. 2, FIG. 7 is a vertical section taken on the line 7—7 of FIG. 2, FIG. 8 is a vertical section taken on the line 8—8 of FIG. 2, FIG. 9 is an enlarged fragmentary horizontal section on the line 9—9 of FIG. 2, FIG. 10 is an enlarged fragmentary vertical section on the line 10—10 of FIG. 1, FIG. 11 is a layout diagram of a control system for this apparatus, and FIG. 12 is a layout diagram of a hydraulic system for the apparatus.

FIG. 1 diagrammatically illustrates an irrigation channel-forming vehicle 10 in accordance with this invention being used to form a channel system at the bottom 12 of a trench 13 being dug by the apparatus. The apparatus 10 may be self-propelled, but the illustrated apparatus is pulled or towed by a suitable vehicle, such as a tractor 15.

The apparatus 10 may be such that it can be used in accordance with standard methods to dig the trench having a bottom at a desired level. However, it is preferable to us the vehicle or apparatus 10 with any known type of laser plane apparatus. An example of suitable apparatus of this type is produced by Laserplane Corporation of Dayton, Ohio. This apparatus consists of a command post 20 set up on a tripod 21 at a suitable location where the apparatus 10 is to work. The command post carries a laser transmitter 24. The length of the command post is adjustable vertically. A receiver 28 is mounted on the upper end of an extensible mast 29 carried by the vehicle 10. A control box (not shown in FIG. 1) is mounted on vehicle 10 and receives signals from receiver 28 and operates a hydraulic system on the vehicle to carry out predetermined operations.

As this laser beam transmitting and receiving apparatus and the control apparatus are known and available on the market neither they nor their operation require detailed description herein.

It is sufficient to say that command post 20 is set up at a desired point in an area where subsurface irrigation channels are desired. During operation, the transmitter rotates and projects a plane of light over the surrounding area, this plane being indicated by numeral 30 in FIG. 1. Apparatus 10 includes a digger for digging the trench 13 with its bottom 12 at a predetermined level relative to the laser plane 30. Mast 29 on the vehicle is adjusted vertically to centralize receiver 28 in plane 30 with the digger of the channel forming apparatus at the desired level. If vehicle 10 rises as it is travelling over the ground, receiver 28 is moved upwardly relative to the laser plane 30, and this causes the control apparatus of the system to lower the digger to the desired level of the trench bottom. This is reversed if the vehicle 10 moves downwardly as it moves over the ground. The present invention is concerned with the apparatus or vehicle which responds to signals when receiver 28 is moved up or down relative to the laser plane.

Referring to FIGS. 2 to 12 of the drawings, the apparatus or vehicle 10 includes a wheel unit or bogie section 35, a control section 38, a digger section 40, a channel forming and distributing section 43, and a follower section 48. These are mounted in succession on a main frame 50. The bogie section 35 leads the vehicle over the ground and includes means for maintaining frame 50 of the vehicle and the various elements carried thereby in a horizontal level position regardless of any reasonable transverse slope of the ground over which the apparatus is travelling.

Control section 38 includes a cabin 55 in which the operator of the vehicle sits, and a platform or deck 56 carried by frame 50. A control box 58 of the laser plane system, mentioned above, is located in this cabin, and mast 29 and receiver 28 are mounted thereon. The digger section 40 includes a digger unit which is adjustable vertically relative to frame 50 in response to signals received by the mechanism in control box 58 from receiver 28. The section 43 includes the means for forming channels in the bottom of the trench being dug out, distributor section 43 receives and screens the earth being dug out and returns the coarse particles thereof to the trench after the channels have been formed, while follower section 48 supports the rear end of the main frame 50 above the refilled trench.

BOGIE SECTION

The bogie section 35 includes a horizontal support 62 forming part of frame 50 at the front end thereof, see FIGS. 2 and 3. A platform 65 is carried by trunnions 66 extending on an axis running longitudinally of apparatus 10 midway between the sides thereof. These trunnions are carried by suitable bearings 67 mounted on support 62. A rotatable base 68 is mounted for rotation around the vertical axis of a pin 69 located centrally of and mounted on platform 65. A carriage 70 is suspended from base 68 and has bogie wheels 71 mounted thereon. A tongue or drawbar 72 is connected to and projects forwardly from base 68 for connection to a suitable towing unit. A lateral sensing unit 74 is mounted on platform 65 and extends transversely thereof. The unit 74 senses any lateral tipping of platform 65 out of the horizontal plane. The unit 74 may be in the form of a mercury switch extending transversely of platform 65 and having contacts at opposite ends thereof which are closed by the mercury of the switch when the platform and switch are tipped laterally. Any other known level sensing device may be used for this purpose. The sensing unit 74 sends appropriate signals to a hydraulic control unit 76 mounted on support 62, this controls the flow of hydraulic fluid to either a first cylinder 78 or a second cylinder 79 mounted at opposite sides of support 62, these cylinders forming part of a standard hydraulic system. Cylinder 78 extends between support 62 and platform 65 at one side of these elements, and cylinder 79 extends between the support and the platform at the opposite side thereof. These cylinders respond to signals from the sensing unit 74 to maintain the frame support 62 level when the wheels 71 move onto ground that is slopped transversely of the vehicle. For example, if the wheels at the side of the bogie section beneath cylinder 79 are raised relative to support 62, this cylinder is retracted and cylinder 78 extended so as to maintain support 62, and consequently, main frame 50 in their normal horizontal position. The action of the cylinders is reversed when the wheels at the opposite side of the bogie section are raised.

A power unit diagrammatically illustrated at 82 is mounted on support 62 in the bogie section for the hydraulic system of the vehicle 10, which includes the cylinders 78 and 79. Another power unit 84 is mounted in the bogie section for the digger section 40. Any suitable power units may be used in this apparatus, such as for example, diesel or gasoline engines. If vehicle 10 were self-propelleled the engine and controls thereof would be mounted in the bogie section.

DIGGER SECTION 40

Frame 50 is formed with arched beams 88 extending upwardly and rearwardly from support 62 of the bogie section 35. In this example, the digger of the vehicle 10 is in the form of a large horizontal drum 90 mounted to rotate around a horizontal axis extending transversely of the frame 50. The drum is mounted on a stationary tubular axle 93 which projects from the ends thereof into holders 94 which are carried by substantial horizontal arms 95. Each arm 95 is mounted for vertical swinging movement at its forward end on a pivot pin 97 carried by a portion of frame 50. The opposite or rearward end of each arm 95 is carried by hydraulic cylinder unit 99 extending from the arm upwardly and forwardly to a pin 100 carried by the main frame. This cylinder unit can be extended and retracted to swing arms 95 so as to raise and lower drum 90 relative to frame 50.

The hollow drum 90 is provided with suitable digging means at the peripheral surface thereof. In this example, the drum has a plurality of digger blades 105 projecting outwardly from the peripheral surface thereof and inclined outwardly in the direction of rotation of the drum. It is preferable to rotate the drum in the direction indicated by arrow 106 in FIG. 2 opposite to the longitudinal movement of the vehicle 10, the direction of movement of the vehicle being indicated by arrow 107 in this Figure. The blades extend transversely of the drum from one end to the other thereof, and each is inclined over one or more openings 110 in the drum periphery.

A cylindrical liner 108 is mounted on spokes 109 within drum 90. The drum actually slides over the outer surface of liner 108, and the spokes are fixedly secured to axle 93 so that the liner remains stationary. This liner has a relatively large slot 112 therein at the top thereof, this slot extending the full width of the drum. A valve plate 113 is slidably mounted on liner 108 and normally closes the slot 112. When this plate is removed, the slot is in communication with a vertical chute 115 which communicates at its lower end with another slot 117 in axle 93. This chute and slot 117 extend the width of the drum and the slot communicates with a trough conveyor 119 within the axle and discharging to either side of vehicle 10.

As drum 90 rotates in the direction of arrow 106 during forward movement of the vehicle 10, the digger blades scoop up earth from the ground over which the apparatus is moving, and directs it into the drum openings 110. This earth is moved over liner 108 and if slot 112 is open, the earth drops down through chute 115 into trough conveyor 119, along which it travels to be discharged from the side of the apparatus. If the slot 112 is closed by plate 113, the digger blades discharge the earth into a bin 122 carried by a sub frame 123 in distributor section 43.

Drum 90 is rotated in any suitable manner. In this example, the power unit 84 has a drive shaft 130 projecting laterally from both sides of the unit. A sprocket 131 on each end of shaft 130 is connected by a chain 132 to a large sprocket 133 connected to the adjacent end of the drum. The two cylinder units 99 are tied into the hydraulic system of the vehicle and are extended and retracted as a result of signals from the control box 58 in response to signals received from receiver 28. If the bogie wheels drop downwardly relative to the laser plane 30, receiver 28 sends signals to cause the cylinder units to be retracted to raise drum 90 so that is forms a trench bottom at a predetermined level relative to the plane. This action is reversed when the bogie wheels move downwardly.

CHANNEL FORMING AND DISTRIBUTING SECTION

Sub frame 123 is mounted for vertical movement relative to frame 50 in section 43 in any suitable manner. In this example, the sub frame is slidably mounted in vertical supports 140 which are secured at their upper ends to frame 50 and extend downwardly therefrom, there being one of these supports at each of the four corners of the sub frame. A plurality of hydraulic cylinder units 144 extend between and are connected to the frame 50 and the sub frame. There are preferably four of these cylinder units, two at each side of the sub frame near the ends thereof.

A screening unit 145 is mounted in bin 122, and suitable power means, not shown, may be provided to vibrate the unit. This unit preferably includes a plurality of superimposed screens, and the illustrated unit includes an upper coarse screen or grizzly 146, an intermediate medium screen 147 and a lower fine screen 148. The upper screen 146 screens out very coarse material, such as rocks, from the earth directed into the upper end of the screening unit by digger drum 90. The intermediate and lower screens 147 and 148 have relatively small perforations therein. For example, grizzly 146 may be in the form of spaced bars running longitudinally of the apparatus, while screens 147 and 148 may be such as to pass particles up to ¼ inch and 1/16 inch, respectively. The screens 146 and 147 direct material into a rearwardly extending and downwardly inclined chute 150. The main forward part of screen 148 overlies a hopper 153, while the rear portion of said screen overlies a rearwardly extending and downwardly inclined chute 154. The screen unit 145, chutes 150 and 154 and hopper 153 extend transversely of the vehicle 10 and are of substantially the same width as the drum 90.

A mixing chamber 158 is mounted at the top of hopper 153. Gate means is provided for the mixing chamber and in this example, the gate means is in the form of a plate 159 located to form a bottom for the chamber. Plate 159 is slidably mounted so that it can be moved from a position closing the bottom of the chamber to a position opening said bottom. As shown in FIG. 5, bottom plate 159 is shifted in and out by cylinder units 161 mounted on the sides of sub frame 123. Suitable mixing means is provided in chamber 158, and in this example, a plurality of paddles 164 are located just above bottom plate 159, and are rotated by any suitable arrangement. In this example, a hydraulic motor 166 is mounted in a narrow housing 167 which extends inwardly from a wall of hopper 153, see FIGS. 2 and 5. The motor is operatively connected to the center paddle 164 through a shaft and gear arrangement 169, and this paddle is connected to the others through a chain drive 170. When bottom plate 159 is withdrawn from the mixing chamber 158, material passing through screen 148 drops right through hopper 153 onto the ground therebeneath. When the bottom plate is in the closed position, the material from screen 148 drops onto this plate where it can be mixed with a suitable soil stabilizer, such as lime, soil cement or the like. This added material may be directed into the mixing chamber in any suitable manner such as by a chute 173 extending from a hopper 174 mounted on frame 50. The additive drops through the screen unit 145 into the upper end of hopper 153. The additive is mixed with the fine earth passing through screen 148 by paddles 164. Bottom plate 159 is reciprocated between the "in" and "out" positions continuously to direct the mixed materials through hopper 153 and on to the ground.

A vertical leveler plate 178 is mounted for vertical adjustment at the rear of the bottom end of hopper 153. This plate is adjusted vertically by a hydraulic cylinder unit 179. The plate 178 determines the depth of the material which is dropped through hopper 153 on the bottom of the trench formed by digger drum 90. Supports 182 extend rearwardly from hopper 153 just above the lower end thereof and at opposite sides of sub frame 123. These supports carry a roller 184 which is mounted on a rotatable axle 185 journalled in the supports 182. This roller has a plurality of circumferentially-spaced ribs 188 on the surface thereof extending transversely of apparatus 10. A central annular rib 189 extends around the surface of the drum, this annular rib being shallower than the transverse ribs 188. The roller 184 is so located that as vehicle 10 advances, it rolls over the surface of the bottom of the trench and the ribs 188 and 189 form transverse and longitudinal channels 190 and 191, respectively, in the bottom of the trench or in the fine material spread over the bottom by hopper 153, see FIG. 4, the depth of this material being determined by the position of leveler plate 178. Although roller 184 may rotate on its own, it is preferably rotated by a suitable drive means.

Any suitable driving means may be provided for roller 184, and in the illustrated example, a hydraulic motor 192 is mounted on sub frame 123 above the roller and is connected thereto in any convenient manner, such as a chain and sprocket drive 193. If desired, there could be a chain and sprocket drive at each end of roller 184. Motor 192 is hydraulically connected to the hydraulic system of the vehicle, the power for which is supplied by power unit 82. The hydraulic controls for motor 192 are located in cabin 55. As hydraulic systems and the controls therefor are well known in the hydraulic industry, they do not require detailed description herein.

As may be desirable to spray a chemical sealant over the material at the bottom of the trench or, for economic reasons, only in the channels formed by roller 184, a sealant tank 194 is mounted in sub frame 123 near the rear end thereof. Any suitable sealant may be used, and this will depend upon the particular soil conditions and the cost. Various mixes of earth, portland cement and water may be used to provide a soil cement. The sealant may be a liquid which when sprayed into the channels dries as a plastic film. This liquid can be derived from an acrylic resin such as polymethyl methacrylate, an amino resin, polyvinyl chloride, or polyvinyl acetal. Tank 194 directs the sealant into a spray system 195 located below the tank see FIGS. 2, 9 and 10. In this example, the spray system includes a transverse spray head 196 which is substantially the length and the width of the transverse channels 190 in the trench bottom, and a longitudinal spray head 197 located centrally of head 196 and extending longitudinally over the longitudinal channels 191 in the trench bottom. A pump 199 driven by an electric motor 200 pumps the sealant from tank 193 to a valve 202 which is operable to direct the sealant to the two end sections of transverse head 196 through pipes 204 and to head 197 through pipe 205. Valve 202 is preferably operable to direct sealant to the transverse head only when the latter is located over a transverse channel in the trench, and to continuously direct the sealant to the longitudinal spray head as the latter travels along the longitudinal channel in the ditch.

Apparatus 10 includes means for directing coarse particulate material into the channels before the trench is filled in. This coarse material may be small stones and finer grit fed off chute 154 to serve as a cushion for heavier filler material dropped after this stage of the apparatus. If the ground being worked does not contain sufficient stones for this purpose, manufactured balls may be used, said balls being formed of plastic or other suitable material or combinations of these. These balls may be manufactured or pelletized from a soil cement mixture similar to that mentioned above covered with a polymethacrylonitrile for strength and resistance to acids and alkalis. A hopper 210 is mounted in sub frame 123 at the rearward end thereof and has an outlet in its bottom for discharging the coarse particles onto chute 154. A rotatable feeder 212 is loacated at the discharge outlet of hopper 210 and when it is desired to feed the coarse particulate material into chute 154, an electric motor 213 is energized which operates the feeder 212 through a drive 214.

A final screen 220 is supported by frame 50 at the rear or discharge end of chute 150. This screen 220 is inclined downwardly and forwardly and discharges at its lower end into a hopper 222 also carried by frame 50.

The screens 146 and 147 discharge the materials retained thereby onto chute 150, and these materials are directed by said chute onto the final screen 220. The smaller particles pass through this screen, and the larger particles are directed into hopper 222 which is open at the bottom thereof so that these larger particles are dropped into the trench just ahead of the depositing of the smaller particles and remaining top soil through the screen.

FOLLOWER SECTION

The follower section 48 includes a transverse roller 225 which preferably extends substantially the width of apparatus 10, this roller being supported by frame 50 and being adjustable vertically relative to the frame. In this example, roller 225 is mounted at its ends in a bracket 227 which is carried by a plurality of hydraulic cylinder units 229 mounted on the back end of frame 50. Cylinder units 229 are operable to raise and lower roller 225 relative to frame 50. This roller rides on the material that has been feed back into the trench, and the back end of the main frame can be raised and lowered by extending or retracting the cylinder units 229. If apparatus 10 is travelling to or from a working site, roller 225 can be lowered sufficiently to lift drum 90 and roller 184 off the ground. On the other hand, when roller 184 is operating to from channels in the bottom of a trench, roller 225 can be raised so as to clear the ground, at which time the weight of a substantial portion of the apparatus is carried by roller 184.

CONTROLS

FIG. 11 diagramatically illustrates the control system for the apparatus of a vehicle 10, and FIG. 12 diagrammatically illustrates the hydraulic system therefor. A pump 235 directs hydraulic fluid from a reservoir 236 to a pressure line 237, and a return line 239 extends back to the reservoir. This pump and reservoir and other elements of the hydraulic system are mounted in a housing 240 located on platform 56. Hydraulic control valve units 76, 243, 244, 245, 246, 247, 250 and 251 are adapted to direct as required pressure fluid to cylinder units or jacks 78–79, 99, 144, 161, 179, 229, and 156, and to motor unit 166, respectively, from pressure line 237, and return fluid from these units back to return line 239.

The control unit 58 controls the operation of the various units in vehicle 10 in response to signals from the laser receiver 28 and controls manipulated by the operator of the vehicle.

OPERATION

When it is desired to form the irrigation channels below the surface of a given area or field, the laser command post 20 is set up so that the transmitter 24 can create a laser plane 30 over the field. This plane may be horizontal or it may be slightly inclined from one side of the field to the other. The vehicle 10 travels back and forth in parallel courses across the field digging trenches 30, forming the water channels 190 and 191 and refilling the trenchs as it travels. If the field has only a very thin layer of top soil and it is desired to save that top soil, vehicle 10 first traverses the field along the desired courses with the sub frame 123 in the upper position, and with digger drum 20 set to dig and remove the top soil. For this operation, valve plate 113 is removed so that the earth removed by digger blades 105 is moved over liner 108 until is drops through opening 112 into the transverse trough conveyor 119, which directs this earth laterally out of the machine. The earth can be deposited along side the shallow trench being dug or it can be directed into a truck moving parallel to and with the vehicle 10. This earth is returned to each trench after the channel system has been formed therein and the dug-out earth returned to partially refill the trench. Where this top soil problem is encountered, two machines can be used. The digger of the first machine being set for removing a suitable layer of top soil only, and the second machine following to put down the complete sub-surface system. After travelling along the first swath for removal of its top soil only, the first machine could operate parallel to and slightly behind the second machine feeding the top soil it is excavating from a new swath into the swaths completed by the second machine.

After this thin layer of top soil has been removed or where the preliminary soil removement is not required, vehicle 10 is operated to form the water channel system. The drum 50 is moved so that it will dig a trench of the desired depth, this digger drum being raised or lowered as required by cylinder units or jacks 99. As the full trench is being dug, valve plate 113 is in the closed position so that all of the earth dug out by the blades 105 is projected into the screening unit 145 of sub frame 123. At this time, the sub frame has been adjusted to a desired height above the bottom of the dug trench by jacks 144. In addition to this, leveler plate 178 has been moved by cylinder unit 179 so as to level the fine earth dropping down through hopper 153 at a desired thickness. The earth passing through screens 146, 147, and 148 drops downwardly through hopper 153. If it is desired to mix an additive with this fine soil before the latter is deposited on the bottom of the trench, the bottom plate 159 is reciprocated back and forth to open and close the passage formed by hopper 153. When plate 159 is in the closed position, the additive is directed from bin 174 through chute 173 into mixing chamber 158 where it is mixed with the fine earth by paddles 164. The mixture drops down onto the bottom of the trench when plate 159 is moved to the open position.

As vehicle 10 progresses, roller 184 rolls over the fine material in the trench and forms transverse and longitudinal channels 190 and 191 by means of ribs 188 and 189. If it is desired to apply a sealant to the water channels, pump 199 is operated and valve 202 directs sealant from tank 193 into the transverse channels 190 through spray head 196 and into the longitudinal channel 191 through spray head 197. If desired, some of the fine material from screen 148 travels down through chute 154 and is spread over the bottom of the channel to provide a cushion for the coarser particulate material deposited therein through screen 220 and hopper 222, this material coming from screens 146 and 147 through chute 150. During this action, roller 225 is retained in an upper position by cylinders 229. This roller may travel along the top of the earth that has been returned to the trench, or it may be raised sufficiently to clear this earth, in which case the load of the back end of vehicle 10 is carried by the ribbed roller 184.

If vehicle 10 encounters a transverse slope, the bogie wheels 71 will assume a transversely inclined position as shown in FIG. 2. However, at this time, the hydraulic unit 74 causes cylinder 78, 79 to be appropriately extended and retracted to keep the main frame 50 and all of the units carried thereby in the proper horizontal position. If the vehicle is travelling over uneven ground and so is raised or lowered relative to laser plane 30, receiver 28 moves with it up or down relative to this plane and this causes digger drum 90 to be lowered or raised as required to maintain the bottom of the trench at a constant level relative to the laser plane.

GENERAL

As apparatus 10 traverses the field it forms below the ground surface longitudinal channels 191 substantially parallel to each other, and transverse channels 190 radiating therefrom. To complete the irrigation system of this field or area, the ends of channels 191 at one side of the field are connected to a header ditch or channel into which water is directed. The longitudinal channels must be level or have a slight fall from the header channel. This water travels from the header channel through longitudinal channels 191 from which it spreads through transverse or lateral channels 190. The lateral channels are a little deeper than the longitudinal channels. Thus the field or area is provided with an underground irrigation system to make water available through capillary action for plants growing at the ground surface.

I claim:

1. A vehicle for forming sub-surface channels, comprising:

a main frame to be moved over the ground, a digger unit mounted on the frame and operable to remove earth from the ground to form a trench of a predetermined width with a bottom below ground level, a channel-forming unit on the frame behind the digger unit with reference to the direction of movement of the main frame operable to form a system of channels in the bottom of the trench, said channel-forming unit comprising a roller mounted to rotate around a substantially horizontal transverse axis, and a plurality of ribs radiating from the roller, said roller being mounted to roll over the bottom of the trench, during which time said ribs impress channels in said bottom, and distributing means on the frame behind the channel-forming unit for spreading earth removed by the digger unit back over the trench bottom.

2. A vehicle as claimed in claim 1 in which said ribs are interconnected, whereby the ribs impress interconnected channels in the trench bottom.

3. A vehicle as claimed in claim 2 comprising power means operatively connected to the roller to rotate said roller in the direction of movement of the main frame.

4. A vehicle as claimed in claim 1 in which said distributing means comprises means for spreading some of the earth removed by the digger unit on the trench bottom ahead of said roller, wherey the ribs of the roller impress the channels in said spread earth on the bottom of the trench.

5. A vehicle as claimed in claim 1 comprising screening means for receiving the earth removed by the digger unit to separate coarse particles from the fine particles thereof, and in which said distributing means comprises means for spreading fine particles of the earth on the trench bottom ahead of said roller, whereby the ribs of the roller impress the channels in said spread earth on the bottom of the trench.

6. A vehicle as claimed in claim 5 comprising a leveler blade mounted ahead of the roller adjustable to level said fine particles at a predetermined depth.

7. A vehicle as claimed in claim 5 comprising means for receiving at least some of the coarse particles and directing said coarse particles into the channels in the trench bottom.

8. A vehicle as claimed in claim 1 comprising:

a hopper on the frame for holding comparatively coarse particles, and means for directing said coarse particles into the channels immediately following the channel-forming unit.

9. A vehicle as claimed in claim 5 comprising a holding tank on the frame for holding a sealant, and means for directing sealant from the tank into said channels to seal the surfaces thereof.

10. A vehicle as claimed in claim 5 comprising means for receiving coarse particles and directing said coarse particles over the trench bottom and channels behind the roller.

11. A vehicle as claimed in claim 1 in which said digger unit and said roller are each mounted for substantially vertical adjustment, and comprising power means connected to the digger unit to raise and lower said digger unit to maintain the bottom of the trench at a constant level, and power means connected to the roller to raise and lower said roller as the digger unit is raised and lowered.

12. A vehicle as claimed in claim 1 comprising a laser light receiver mounted on the frame where it can intersect a plane of laser light located the ground, said receiver being connected to said power means to operate the latter to maintain the bottom of the trench at a constant level relative to said laser light plane.

13. A vehicle as claimed in claim 11 comprising a laser light receiver mounted on the frame where it can intersect a plane of laser light located above the ground, said receiver being connected to said power means to operate the latter to maintain the bottom of the trench at a constant level relative to said laser light plane.

14. A vehicle for forming sub-surface channels comprising:

a main frame to be moved over the ground, a digger unit mounted on the frame and operable to remove earth from the ground to form a trench of a predetermined width with a bottom below ground level, a channel-forming unit on the frame behind the digger unit with reference to the direction of movement of the main frame operable to form a system of channels in the bottom of the trench, distributing means on the frame behind the channel-forming unit for spreading earth removed by the digger unit back over the trench bottom, a wheel unit at the front end of the main frame, mounting means between the wheel unit and the frame front end allowing for relative lateral rocking movement between the frame and wheel unit, and control means carried by and operatively connected to the frame to keep the digger unit therein in a normal position to dig a trench with a substantially horizontal bottom regardless of lateral rocking movement of the wheel unit.

15. A vehicle as claimed in claim 14 in which said digger unit is mounted for substantially vertical adjustment, and comprising power means connected to the digger unit to raise and lower said digger unit to maintain the bottom of the trench at a constant level.

16. A vehicle as claimed in claim 15 comprising a laser light receiver mounted on the frame where it can intersect a plane of laser light located above the ground, said receiver being connected to said power means to operate the latter to maintain the bottom of the trench at a constant level relative to said laser light plane.

17. A vehicle for forming sub-surface channels, comprising:

a main frame to be moved over the ground, a wheel unit at a front end of the frame, a digger drum unit mounted on the frame to rotate around a substantially horizontal transverse axis to remove earth from the ground to form a trench of a predetermined width with a bottom below ground level, said digger unit also being mounted for selected vertical movement relative to the frame, power means connected to the digger unit to raise and lower said digger unit to maintain the bottom of the trench at a constant level, means for receiving earth dug out by the digger unit, a channel-forming unit on the frame behind the digger unit with reference to the direction of movement of the main frame operable to form a system of channels in the bottom of the trench, and distributing means on the frame behind the channel-forming unit for spreading earth from said receiving means back over the trench bottom.

18. A vehicle as claimed in claim 17 comprising mounting means between the wheel unit and the frame front end allowing for relative lateral rocking movement between the frame and wheel unit, and control means carried by and operatively connected to the frame to keep the digger unit therein in a normal position to dig a trench with a substantially horizontal bottom regardless of lateral rocking movement of the wheel unit.

19. A vehicle as claimed in claim 17 comprising a laser light receiver mounted on the frame where it can intersect a plane of laser light located above the ground, said receiver being connected to said power means to operate the latter to maintain the bottom of the trench at a constant level relative to said laser light plane.

20. A vehicle as claimed in claim 17 in which said channel-forming unit comprises:

a roller mounted to rotate around a substantially horizontal transverse axis, and a plurality of ribs radiating from the roller, said roller being mounted to roll over the bottom of the trench, during which time said ribs impress channels in said bottom.

21. A vehicle as claimed in claim 20 in which said ribs are interconnected, whereby the ribs impress interconnected channels in the trench bottom.

22. A vehicle as claimed in claim 21 comprising power means operatively connected to the roller to rotate said roller in the direction of movement of the main frame.

23. A vehicle as claimed in claim 20 in which said distributing means comprises means for speading some of the earth removed by the digger unit on the trench bottom ahead of said roller, whereby the ribs of the roller impress the channels in said spread earth on the bottom of the trench.

24. A vehicle as claimed in claim 20 comprising screening means for receiving the earth removed by the digger unit to separate coarse particles from fine particles thereof, and in which said distributing means comprises means for spreading fine particles of the earth on the trench bottom ahead of said roller, whereby the ribs of the roller impress the channels and said spread earth on the bottom of the trench.

25. A vehicle as claimed in claim 24 comprising a leveler blade mounted ahead of the roller adjustable to level said fine particles at a predetermined depth.

26. A vehicle as claimed in claim 17 comprising:

a holding tank on the frame for holding a sealant, and means for directing sealant from the tank into said channels to seal the surfaces thereof.

27. A vehicle as claimed in claim 24 comprising a mixing chamber on the frame positioned to receive fine particles from said screening means, hopper means supported to direct a soil stabilizer into the mixing chamber, gate means for the mixing chamber positioned to close and open the bottom of said chamber, mixing means in said chamber, and operating means for the gate means to cause said gate means to close and open the chamber bottom.

28. A vehicle for forming subsurface channels, comprising:

a main frame to be moved over the ground, a wheel unit at a front end of the frame, a digger drum unit mounted on the frame to rotate around a substantially horizontal transverse axis to remove earth from the ground to form a trench of a predetermined width with a bottom below ground level, said digger unit also being mounted for selected vertical movement relative to the frame, first power means connected to the digger unit to raise and lower said digger unit to maintain the bottom of the trench at a constant level, a sub frame mounted for vertical adjustment on the main frame behind the digger unit with reference to to the direction of movement of the main frame, means on the sub frame for receiving earth dug out by the digger unit, a channel-forming unit on the sub frame operable to form a system of channels in the bottom of the trench, second power means connected to the sub frame to raise and lower said sub frame and the roller mounted thereon as the digger unit is raised and lowered, and distributing means on the main frame behind the channel-forming unit for spreading earth from said receiving means back over the trench bottom.

29. A vehicle as claimed in claim 28 comprising a laser light receiver mounted where it can intersect a plane of laser light located above the ground, and control means responsive to signals from said receiver to cause said first power means and said second power means to raise and lower the digger unit and the sub frame to maintain the bottom of the trench and the system of channels at constant levels relative to said laser plane.

30. A vehicle as claimed in claim 29 comprising mounting means between the main frame and the wheel unit, and control means carried by and operatively connected to the main frame to keep the digger unit and the sub frame in normal positions to dig a trench with a substantially the horizontal bottom regardless of lateral rocking movement of the wheel unit.

31. A vehicle as claimed in claim 29 in which said channel-forming unit comprises:

a roller mounted to rotate around a substantially horizontal transverse axis, and a plurality of interconnected ribs radiating from the roller, said roller being mounted to roll over the bottom of the trench, during which time said ribs impress interconnected channels in said bottom.

32. A vehicle as claimed in claim 31 in which said distributing means comprises means on the sub frame for spreading some of the earth removed by the digger unit on the trench bottom ahead of said roller, whereby the ribs of the roller impress the channels in said spread earth on the bottom of the trench.

33. A vehicle as claimed in claim 31 comprising screening means mounted on the sub frame for receiving earth removed by the digger unit to separate coarse particles from fine particles thereof, and in which said distributing means comprises means for spreading fine particles of the earth on the trench bottom ahead of said roller, whereby the ribs of the roller impress the channels and said spread earth on the bottom of the trench.

34. A vehicle as claimed in claim 33 comprising a leveler blade mounted in the sub frame and ahead of the roller adjustable relative to the roller to level said fine particles at a predetermined depth.

35. A vehicle as claimed in claim 33 comprising means for receiving at least some of the coarse particles and directing said coarse particles into the channels in the trench bottom.

36. A vehicle as claimed in claim 29 comprising a hopper on the sub frame for holding comparatively coarse particles, and means for directing said coarse particles into the channels ahead of said distributing means.

37. A vehicle as claimed in claim 29 comprising a holding tank on the sub frame for holding a sealant, and means for directing sealant from the tank into said channels to seal the surfaces thereof.

38. A vehicle as claimed in claim 33 comprising a mixing chamber on the sub frame positioned to receive fine particles from said screening means, hopper means supported to direct a soil stabilizer into the mixing chamber, gate means for the mixing chamber positioned to close and open the bottom of said chamber, mixing means in said chamber, and operating means for the gate means to cause said gate means to close and open the chamber bottom.

* * * * *